US009589502B2

(12) United States Patent
Hong et al.

(10) Patent No.: US 9,589,502 B2
(45) Date of Patent: Mar. 7, 2017

(54) ORGANIC LIGHT EMITTING DISPLAY DEVICE WITH INITIALIZATION CIRCUIT AND DRIVING METHOD OF THE SAME

(71) Applicants: Seung Kyun Hong, Yongin (KR); Dong Hwan Lee, Yongin (KR); So Young Park, Yongin (KR); In Soo Lee, Yongin (KR)

(72) Inventors: Seung Kyun Hong, Yongin (KR); Dong Hwan Lee, Yongin (KR); So Young Park, Yongin (KR); In Soo Lee, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 314 days.

(21) Appl. No.: 13/926,524

(22) Filed: Jun. 25, 2013

(65) Prior Publication Data

US 2014/0146029 A1 May 29, 2014

(30) Foreign Application Priority Data

Nov. 23, 2012 (KR) ..... 10-2012-0133827

(51) Int. Cl.
*G09G 3/32* (2016.01)

(52) U.S. Cl.
CPC ... *G09G 3/3233* (2013.01); *G09G 2300/0819* (2013.01); *G09G 2300/0842* (2013.01); *G09G 2310/0251* (2013.01); *G09G 2320/045* (2013.01)

(58) Field of Classification Search
CPC ..... G09G 3/3233; G09G 2300/0819; G09G 2320/045
USPC ..... 345/82, 212
See application file for complete search history.

(56) References Cited

U.S. PATENT DOCUMENTS

2011/0025671 A1* 2/2011 Lee ..... G09G 3/003 345/211
2011/0109531 A1* 5/2011 Choi ..... 345/76
2011/0279484 A1* 11/2011 Han ..... G09G 3/3233 345/690
2012/0019505 A1* 1/2012 Hwang ..... 345/212
2012/0162275 A1* 6/2012 Park ..... 345/690
2012/0235973 A1* 9/2012 Yoo ..... G09G 3/3233 345/211
2012/0306840 A1* 12/2012 Han ..... G09G 3/003 345/212
2013/0155033 A1* 6/2013 Jin et al. ..... 345/204

FOREIGN PATENT DOCUMENTS

KR 10-2011-0131961 A 12/2011
KR 10-2012-0065137 A 6/2012
KR 10-2012-0070974 A 7/2012

* cited by examiner

*Primary Examiner* — Jonathan Blancha
(74) *Attorney, Agent, or Firm* — Lee & Morse, P.C.

(57) ABSTRACT

An organic light emitting display device includes an organic light emitting display panel, and a driver that drives the organic light emitting display panel. The driver applies a first power voltage and a second power voltage to the organic light emitting display panel, the first power voltage is lower than the second power voltage during a first period, and the first power voltage is higher than the second power voltage during a second period.

20 Claims, 6 Drawing Sheets

ORGANIC LIGHT EMITTING DISPLAY DEVICE WITH INITIALIZATION CIRCUIT AND DRIVING METHOD OF THE SAME

CROSS-REFERENCE TO RELATED APPLICATION

This application claims priority under 35 U.S.C. §119 to Korean Patent Application No. 10-2012-0133827 filed on Nov. 23, 2012, in the Korean Intellectual Property Office, the disclosure of which is incorporated herein by reference in its entirety.

BACKGROUND

With the trend toward the lighter and slimmer displays, including for portable display devices, e.g., notebook computers, mobile phones, and portable media players, and including for home display devices, e.g., TV sets and monitors, a variety of flat panel displays are being used. The flat panel display includes a display panel and may be classified, e.g., into a liquid crystal display, an organic electroluminescent display device, an electrophoretic display device, and the like, according to the kind of display panel.

SUMMARY

Embodiments may be realized by providing an organic light emitting display device that includes an organic light emitting display panel, and a driver driving the organic light emitting display panel. The driver supplies a first power voltage and a second power voltage to the organic light emitting display panel, the first power voltage is lower than the second power voltage during a first period, and the first power voltage is higher than the second power voltage during a second period.

The first period and the second period may be alternately provided. The organic light emitting display panel may include a plurality of pixels, each of the plurality of pixels including an organic light emitting diode and a driving transistor controlling the current flowing in the organic light emitting diode. The first power voltage may be applied to a cathode of the organic light emitting diode, and the second power voltage may be applied to a source of the driving transistor.

Each of the plurality of pixels may include a first emission control transistor that is connected to the source of the driving transistor and that controls whether the second power voltage is to be applied to the source of the driving transistor, and may include a second emission control transistor that is connected to a drain of the driving transistor and an anode of the organic light emitting diode.

The first emission control transistor and the second emission control transistor may be controlled by an emission control signal, and a potential of the emission control signal may be one of an emission-on voltage and an emission-off voltage. When the emission control signal has the potential of the emission-on voltage, the first emission control transistor and the second emission control transistor may be turned on, and during the second period, the emission control signal may have the potential of the emission-on voltage.

All emission signals applied to the plurality of pixels may have the potential of the emission-on voltage during the second period. The driver may include an emission driver generating the emission control signal.

The emission driver may include a first emission driver sequentially applying the emission-on voltage of the emission control signal to the plurality of pixels, and a second emission signal generator simultaneously applying the emission-on voltage of the emission control signal to the plurality of pixels. The first emission driver may be turned off and the second emission driver may be turned on during the second period.

During the second period, the first emission control transistor may be turned on to apply the second power voltage to the source of the driving transistor, and the second emission control transistor may be turned on to connect the drain of the driving transistor to the anode of the organic light emitting diode. During the second period, all of the first emission control transistors and the second emission control transistors included in the plurality of pixels may be turned on.

The driver may apply first to nth scan signals and first to mth data signals to the organic light emitting display panel. Potentials of the first to nth scan signals may be scan-on voltages or scan-off voltages, the first to nth scan signals may sequentially have potentials of the scan-on voltages during a scan period, and the second period may be placed between two neighboring scan periods.

Embodiments may also be realized by providing an organic light emitting display device that includes, during a scan period, the first to nth scan signals supplied to the organic light emitting display panel sequentially having potentials of scan-on voltages to then be changed to scan-off voltages, a first power voltage and a second power voltage supplied to the organic light emitting display panel between two neighboring scan periods, the first power voltage has a higher potential than the second power voltage to then be changed to have a lower potential than the second power voltage, and during the scan period, the first power voltage has a lower potential than the second power voltage.

The organic light emitting display panel may include a plurality of pixels, each of the plurality of pixels including an organic light emitting diode and a driving transistor controlling the current flowing in the organic light emitting diode. The first power voltage may be applied to a cathode of the organic light emitting diode, and the second power voltage may be applied to the source of the driving transistor.

Embodiments may also be realized by providing a driving method of an organic light emitting display device that includes allowing potentials of first to nth emission signals supplied to an organic light emitting display panel to sequentially have emission-on voltages to then be changed into emission-off voltages, and supplying a first power voltage and a second power voltage supplied to the organic light emitting display panel between two neighboring scan periods. While the first power voltage has a higher potential than the second power voltage, all of the first to nth emission signals have emission-on voltage potentials, and a length of a period in which the first power voltage has a higher potential than the second power voltage is smaller than a period in which the second power voltage has a higher potential than the first power voltage.

The organic light emitting display panel may include a plurality of pixels, and each of the plurality of pixels may receive one of the first to nth emission signals and light may be emitted when one of the first to nth emission signals has the emission-on voltage. The emission driver may applying the first to nth emission signals to the organic light emitting display panel may include a first emission driver and a second emission driver. The first emission driver may generate the first to nth emission signals to sequentially have emission-on voltages to then be changed into emission-off voltages, and the second emission driver may generate the first to nth emission signals to simultaneously have emission-on voltages.

When the first emission driver is turned on, the second emission driver may be turned off, and when the second emission driver is turned on, the second emission driver may be turned on. While the first power voltage has the higher potential than the second power voltage, the second emission driver may be turned on. While the second power voltage has the higher potential than the first power voltage, the first emission driver may be turned on.

BRIEF DESCRIPTION OF THE DRAWINGS

Features will become more apparent to those of ordinary skill in the art by describing in detail exemplary embodiments thereof with reference to the attached drawings in which.

DETAILED DESCRIPTION

Figure 1:
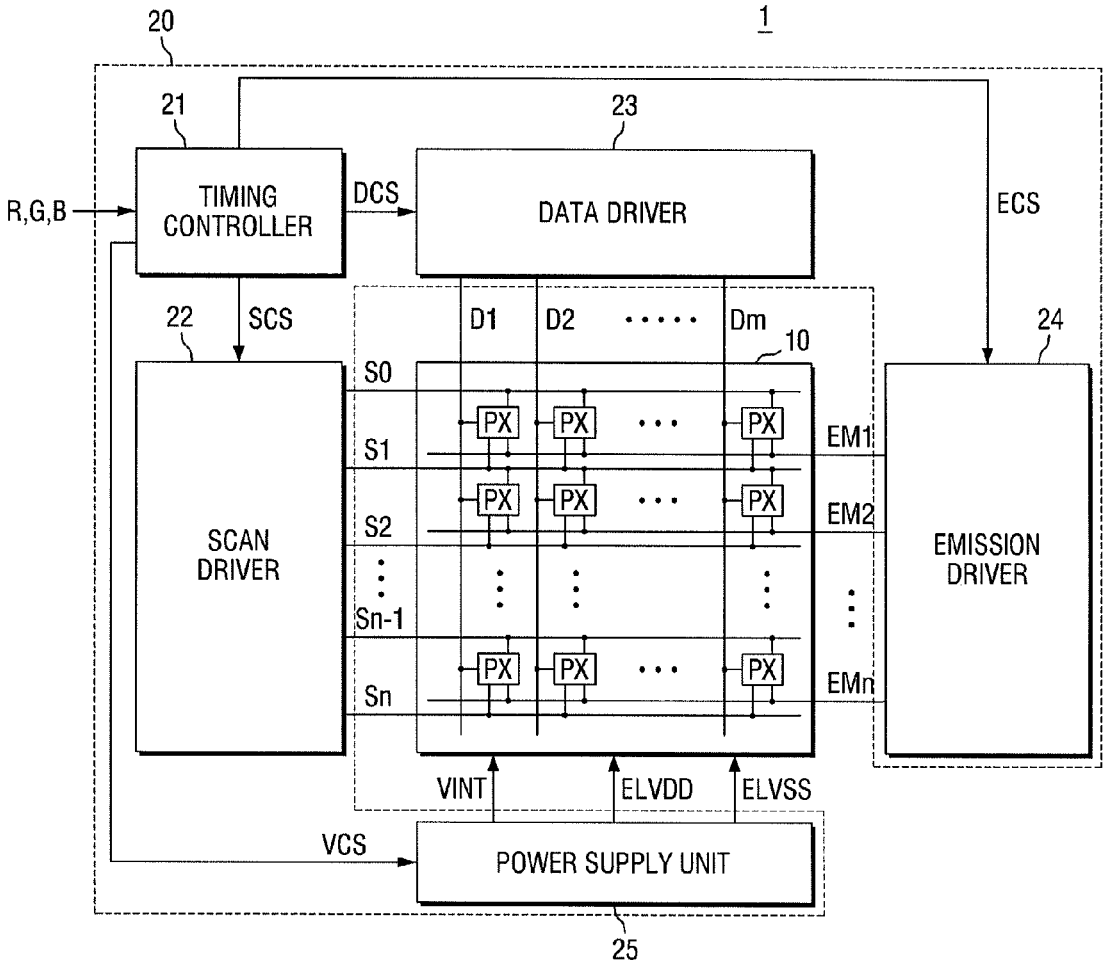
FIG. 1 is a block diagram of an organic light emitting display device according to an exemplary embodiment.

Features and methods of accomplishing the same may be understood more readily by reference to the following detailed description of preferred embodiments and the accompanying drawings. Embodiments may, however, be embodied in many different forms and should not be construed as being limited to the exemplary embodiments set forth herein. Rather, these embodiments are provided so that this disclosure will be thorough and complete and will fully convey the concept of the embodiments to those skilled in the art, and the present invention will only be defined by the appended claims. Thus, in some embodiments, well-known structures and devices are not shown in order not to obscure the description with unnecessary detail. Like numbers refer to like elements throughout. In the drawings, the thickness of layers and regions are exaggerated for clarity.

It will be understood that, although the terms first, second, etc. may be used herein to describe various elements, these elements should not be limited by these terms. These terms are only used to distinguish one element from another element. Thus, for example, a first element, a first component or a first section discussed below could be termed a second element, a second component or a second section without departing from the teachings.

Hereinafter, exemplary embodiments will be described in further detail with reference to the accompanying drawings.

FIG. 1 is a block diagram of an organic light emitting display device according to an exemplary embodiment.

Referring to FIG. 1, the organic light emitting display device 1 includes an organic light emitting display panel 10 and a driver 20.

The organic light emitting display panel 10 includes a plurality of pixels (PX). The plurality of pixels PX may be arranged in a matrix configuration, but aspects of the embodiments are not limited thereto. Each of the plurality of pixels PX may include an organic light emitting diode, and the organic light emitting display panel 10 may display an image by controlling the luminance of the organic light emitting diodes.

The organic light emitting display panel 10 may receive 0th to nth scan signals S0, S1, . . . , and Sn, first to mth data signals D1, D2, . . . , and Dm, first to nth emission control signals EM1, EM2, . . . , and EMn, an initialization voltage VINT, a first power voltage ELVSS and a second power voltage ELVDD from the driver 20 and may display images corresponding thereto.

The first to mth data signals D1, D2, . . . , and Dm may include information concerning gray scales of images displayed on the organic light emitting display panel 10. The 0th to nth scan signals S0, S1, . . . , and Sn may control the plurality of pixels PX to receive or not to receive the first to mth data signals D1, D2, . . . , and Dm, e.g., may control whether ones of the plurality of pixels PX receive data information. However, according to an exemplary embodiment, the 0th scan signal S0 may be used for initialization of the pixels PX, and may not control the plurality of pixels PX to receive or not to receive the first to mth data signals D1, D2, . . . , and Dm.

The first to nth emission control signals EM1, EM2, . . . , and EMn may control the organic light emitting diodes included in the plurality of pixels PX to emit or not to emit light, e.g., may control whether ones of the plurality of pixels PX emit light. The first power voltage ELVSS and the second power voltage ELVDD may function as the power source for driving the organic light emitting display panel 10. The first power voltage ELVSS may be a voltage higher than or equal to the second power voltage ELVDD during a particular period. Accordingly, the voltage applied to the anode of the organic light emitting diode is initialized, thereby improving display quality of a black image of the organic light emitting display device 1, which will be described later in more detail.

The driver 20 may receive image data (R, G, B) and may control the organic light emitting display panel 10 to display images corresponding to the received image data (R, G, B). In order to control the organic light emitting display panel 10, the driver 20 may generate the 0th to nth scan signals S0, S1, . . . , and Sn, the first to mth data signals D1, D2, . . . , and Dm, the first to nth emission control signals EM1, EM2, . . . , and EMn, the initialization voltage VINT, the first power voltage ELVSS, and the second power voltage ELVDD.

The driver 20 may include a timing controller 21, a scan driver 22 (e.g., a gate driver), a data driver 23, an emission driver 24, and a power supply unit 25. The timing controller 21, the scan driver 22, the data driver 23, the emission driver 24, and the power supply unit 25 may be formed as an integrated circuit (IC) or may be formed as independent ICs. Alternatively, only some of these components may be formed as an integrated circuit (IC).

The timing controller 21 may receive the image data (R, G, B) and may generate a scan driver control signal SCS, a data driver control signal DCS, an emission driver control signal ECS, and a power supply unit control signal VCS, corresponding to the received image data (R, G, B).

The scan driver 22 may receive the scan driver control signal SCS and may generate the 0th to nth scan signals S0, S1, . . . , and Sn. Each of the 0th to nth scan signals S0, S1, . . . , and Sn may have a potential of a scan-on voltage or a scan-off voltage, and the 0th to nth scan signals S0, S1, . . . , and Sn may sequentially have potentials of scan-on voltages. When the first to nth scan signals S1, S2, . . . , and Sn have potentials of scan-on voltages, the first to mth data signals D1, D2, . . . , and Dm may be transmitted to the plurality of pixels PX.

The data driver 23 may receive the data driver control signal DCS and may generate the first to mth data signals D1, D2, . . . , and Dm corresponding to the received data driver control signal DCS. The first to mth data signals D1, D2, . . . , and Dm may be generated to be synchronized with the first to nth scan signals S1, S2, . . . , and Sn.

The emission driver 24 may receive the emission driver control signal ECS and may generate the first to nth emission signals EM1, EM2, . . . , and EMn. Each of the first to nth emission signals EM1, EM2, . . . , and EMn may have a potential of an emission-on voltage or an emission-off voltage. The organic light emitting diodes included in the pixels PX receiving the first to nth emission signals EM1, EM2, . . . , and EMn having emission-on voltage potentials may emit light. After the potential of the ith scan signal Si is changed from the scan-on voltage to the scan-off voltage, the ith emission signal EMi may be changed from the emission-off voltage to the emission-on voltage. Here, i is a natural number between 1 and n.

The power supply unit 25 may supply the initialization voltage VINT, the first power voltage ELVSS, and the second power voltage ELVDD to the organic light emitting display panel 10. The power supply unit 25 may receive a voltage supply control signal VCS and may vary the first power voltage ELVSS so as to correspond to the received voltage supply control signal VCS. Since the organic light emitting display device 1 initializes the voltage applied to the anode of the organic light emitting diode by varying the first power voltage ELVSS, the voltage applied to the anode of the organic light emitting diode can be initialized without an additional circuit provided in the pixels PX. In addition, the voltage applied to the anode of the organic light emitting diode is initialized, thereby improving the display quality of the black image.

Figure 2:
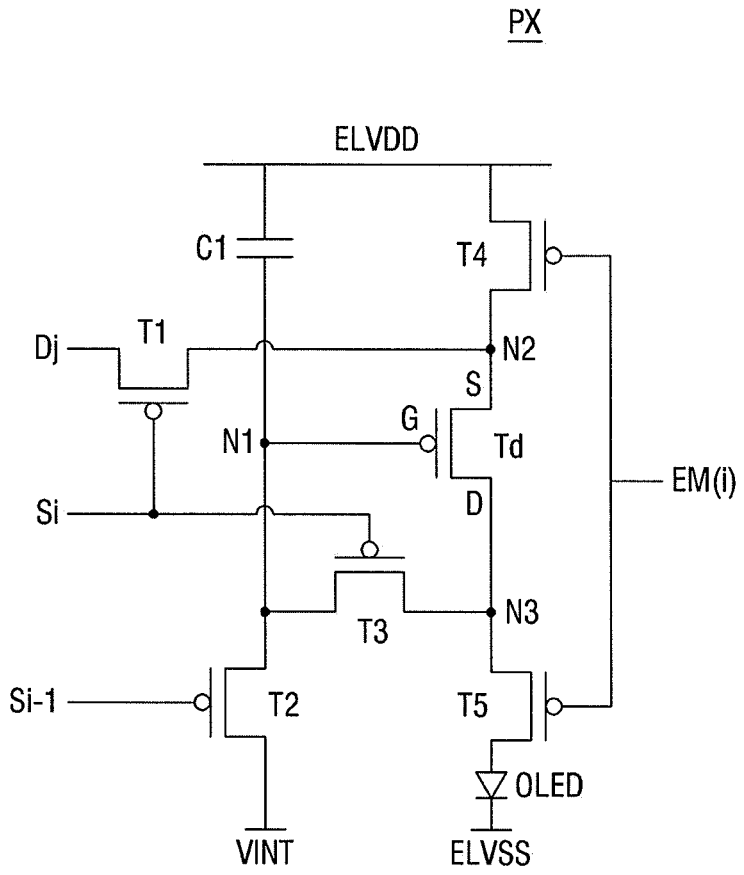
FIG. 2 is a circuit diagram of a pixel according to an exemplary embodiment.

Hereinafter, a driving method of the organic light emitting display device 1 will be described in more detail. FIG. 2 is a circuit diagram of a pixel according to an exemplary embodiment.

Referring to FIG. 2, the pixel PX may include a data control transistor T1, a driving transistor Td, an organic light emitting diode OLED, and a capacitor C1.

The organic light emitting diode OLED may emit light with luminance corresponding to the magnitude of current flowing from an anode to a cathode of the organic light emitting diode OLED. The first power voltage ELVSS may be applied to the cathode of the organic light emitting diode OLED. The anode of the organic light emitting diode OLED may be connected to a third node N3. A second emission control transistor T5 may control the anode of the organic light emitting diode OLED as to whether the anode is to be connected or is to be disconnected from the third node N3.

The driving transistor Td may include a source S connected to a second node N2 to which the second power voltage ELVDD is applied, a drain D connected to the third node N3, and a gate G connected to a first node N1. The driving transistor Td may receive a jth data signal Dj through the data control transistor T1 connected to the second node N2. Here, j is a natural number between 1 and m. The driving transistor Td may control the current flowing in the organic light emitting diode OLED. The magnitude of the current flowing in the organic light emitting diode OLED may correspond to a potential difference between the source S and the gate G of the driving transistor Td.

The data control transistor T1 may include a source receiving the jth data signal Dj, a drain connected to the second node N2 and a gate receiving the ith scan signal Si. If the ith scan signal Si has a scan-on voltage potential, the data control transistor T1 may be turned on to transmit the jth data signal Dj to the second node N2.

One end of the capacitor C1 may be connected to the first node N1, which is connected to the gate G of the driving transistor Td, and the second power voltage ELVDD may be applied to the other end of the capacitor C1. Therefore, the capacitor C1 may store the voltage of the gate G of the driving transistor Td. The pixel PX may further include a threshold voltage compensation transistor T3. The ith scan signal Si may be transmitted to the gate of the threshold voltage compensation transistor T3. If the ith scan signal Si has a scan-on voltage potential, the threshold voltage compensation transistor T3 may be turned on, and the threshold voltage compensation transistor T3 may connect the gate G of the driving transistor Td to the drain D, thereby diode-connecting the driving transistor Td.

If the driving transistor Td is diode-connected, a voltage dropped by subtracting a threshold voltage of the driving transistor Td from the voltage of the jth data signal Dj applied to the source S of the driving transistor Td, may be applied to the gate of the driving transistor Td. The gate G of the driving transistor Td is connected to one end of the capacitor C1 and the voltage applied to the gate G of the driving transistor Td is maintained. Since the voltage with the threshold voltage of the driving transistor Td reflected thereon is applied to the gate G and maintained, the current flowing between the source S and the drain D of the driving transistor Td may not be affected by the threshold voltage of the driving transistor Td.

The pixel PX may further include an initialization transistor T2. An (i−1)th scan signal Si−1 may be applied to a gate of the initialization transistor T2. If the (i−1)th scan signal Si−1 has a scan-on voltage potential, the initialization transistor T2 is turned on to apply the VINT to the gate G of the driving transistor Td, thereby initializing the potential of the gate G of the driving transistor Td.

The pixel PX may further include a first emission control transistor T4 and a second emission control transistor T5. An ith emission control signal EMi may be transmitted to the gate of the first emission control transistor T4. If the ith emission control signal EMi has an emission-on voltage potential, the first emission control transistor T4 is turned on to supply the second power voltage ELVDD to the second node N2. The ith emission control signal EMi may be transmitted to the gate of the second emission control transistor T5. If the ith emission control signal EMi has the emission-on voltage potential, the second emission control transistor T5 is turned on to connect the third node N3 to the anode of the organic light emitting diode OLED. If the ith emission control signal EMi has the emission-on voltage potential, the first emission control transistor T4 and the second emission control transistor T5 are turned on. Then, while the ith scan signal Si has a scan-on voltage potential, current is generated between the source S and the drain D of the driving transistor Td so as correspond to the jth data signal Dj stored in the capacitor C1, and the current flows in the organic light emitting diode OLED, thereby emitting light.

Figure 3:
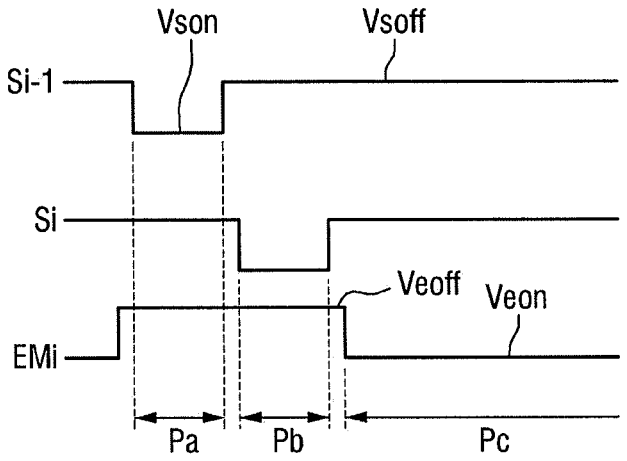
FIG. 3 is a waveform diagram illustrating waveforms of ith and (i−1)th scan signals and an ith emission control signal according to an exemplary embodiment.

Hereinafter, the principle in which the pixel PX is driven will be described in more detail with reference to FIG. 3. FIG. 3 is a waveform diagram illustrating waveforms of ith and (i−1)th scan signals and an ith emission control signal according to an exemplary embodiment.

Referring to FIG. 3, the (i−1)th scan signal Si−1 may have a potential of a scan-on voltage Vson during an ath period Pa. After receiving the (i−1)th scan signal Si−1, the initialization transistor T2 is turned on during the ath period Pa to initialize the potential of the gate G of the driving transistor Td to the initialization voltage VINT.

During a bth period Pb subsequent to the ath period Pa, the ith scan signal Si may have a potential of the scan-on voltage Vson and the (i−1)th scan signal Si−1 may have a potential of the scan-off voltage Vsoff. There may be a time between the ath period Pa and the bth period Pb in which the (i−1)th scan signal has the scan-off voltage Vsoff and the ith scan signal Si has the scan-off voltage Vsoff.

During the bth period Pb, the initialization transistor T2 is turned off to make the second node N2 float. Here, during the bth period Pb, the data control transistor T1 and the threshold voltage compensation transistor T3, which receive the ith scan signal Si, may be turned on. Then, during the bth period Pb, a data voltage based on the jth data signal Dj may be transmitted to the source S of the driving transistor Td through the data control transistor T1, and the driving transistor Td may be diode-connected by the threshold voltage compensation transistor T3. Therefore, during the bth period Pb, the voltage maintained in the first node N1 connected to one end of the capacitor C1 corresponds to a potential difference between the gate G and the source S of the driving transistor Td, that is, a voltage obtained by dropping a threshold voltage of the driving transistor Td from the voltage of the jth data signal Dj.

During a cth period Pc subsequent to the bth period Pb, the ith emission control signal EMi having a potential of the ath period Pa and the bth period Pb may have a potential of the emission-on voltage Veon. In the bth period Pb and the ath period Pa, the EMi may have the emission-off voltage of Veoff. During the cth period Pc, the ith scan signal Si and the (i−1)th scan signal Si−1 may have a potential of the emission-off voltage Vsoff. In the cth period Pc, the first and second emission control transistors T4 and T5, which receive the ith emission control signal EMi are turned on, the current corresponding to the voltage stored in the capacitor C1 may be transmitted to the organic light emitting diode OLED, thereby emitting light.

Figure 4:
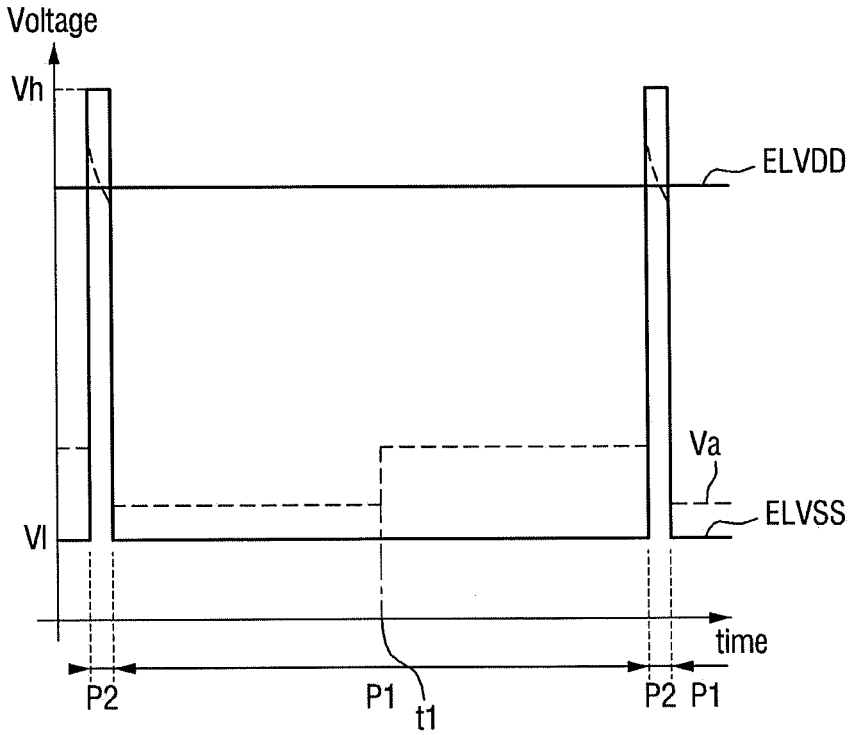
FIG. 4 is a graph illustrating a first power voltage, a second power voltage, and a third node voltage according to an exemplary embodiment.

Hereinafter, a method of initializing a voltage of the anode of the organic light emitting diode OLED will be described in more detail. FIG. 4 is a graph illustrating a first power voltage, a second power voltage and a third node voltage according to an exemplary embodiment.

Referring to FIG. 4, the second power voltage ELVDD may have a constant potential and the first power voltage ELVSS may have a variable potential. The first power voltage ELVSS may vary so as to have a value of a low voltage Vl or a high voltage Vh. The low voltage Vl may be lower than the second power voltage ELVDD, and the high voltage Vh may be higher than the second power voltage ELVDD. The first power voltage ELVSS may have a potential of the low voltage Vl during a first period P1, and may have a potential of the high voltage Vh during a second period P2. In order to reduce the possibility of and/or prevent the second period P2 from affecting an image, the second period P2 may be shorter than the first period P1. For example, the second period P2 may have a length of duration of 30 μs or less. The first period P1 and the second period P2 may be alternately placed.

If the potential of the first power voltage ELVSS is changed from the low voltage Vl to the high voltage Vh when the period makes transition from the first period P1 to the second period P2, the anode voltage Va of the organic light emitting diode OLED may also increase along with the change of the first power supply voltage ELVSS due to coupling of internal capacitance of the organic light emitting diode OLED.

If the anode voltage Va of the organic light emitting diode OLED increases in the first period P1, the driving transistor Td may be turned on. If the driving transistor Td is turned on, the anode voltage Va of the organic light emitting diode OLED may be dropped to a voltage obtained by subtracting the threshold voltage of the driving transistor Td from the second power voltage ELVDD.

If the potential of the first power voltage ELVSS is changed from the high voltage Vh to the low voltage Vl when the period makes transition from the second period P2 to the first period P1, the driving transistor Td is turned off, the anode voltage Va of the organic light emitting diode OLED may decrease to be lower than the voltage capable of turning on the organic light emitting diode OLED due to coupling of internal capacitance of the organic light emitting diode OLED. Therefore, when the period makes transition from the second period P2 to the first period P1, the anode voltage Va of the organic light emitting diode OLED may be initialized. If the anode voltage Va of the organic light emitting diode OLED is initialized, display quality of a black image of the organic light emitting display device 1 may be improved.

In addition, since the organic light emitting display device 1 can initialize the anode voltage Va of the organic light emitting diode OLED by varying the first power voltage ELVSS, it is not necessary to provide additional circuit for initializing the anode voltage Va of the organic light emitting diode OLED in the pixel PX. Therefore, a configuration of the organic light emitting display panel 10 may be simplified.

At a time t1, the anode voltage Va of the organic light emitting diode OLED may increase. The time t1 may be a point of time at which the organic light emitting diode OLED starts emitting light.

Figure 5:
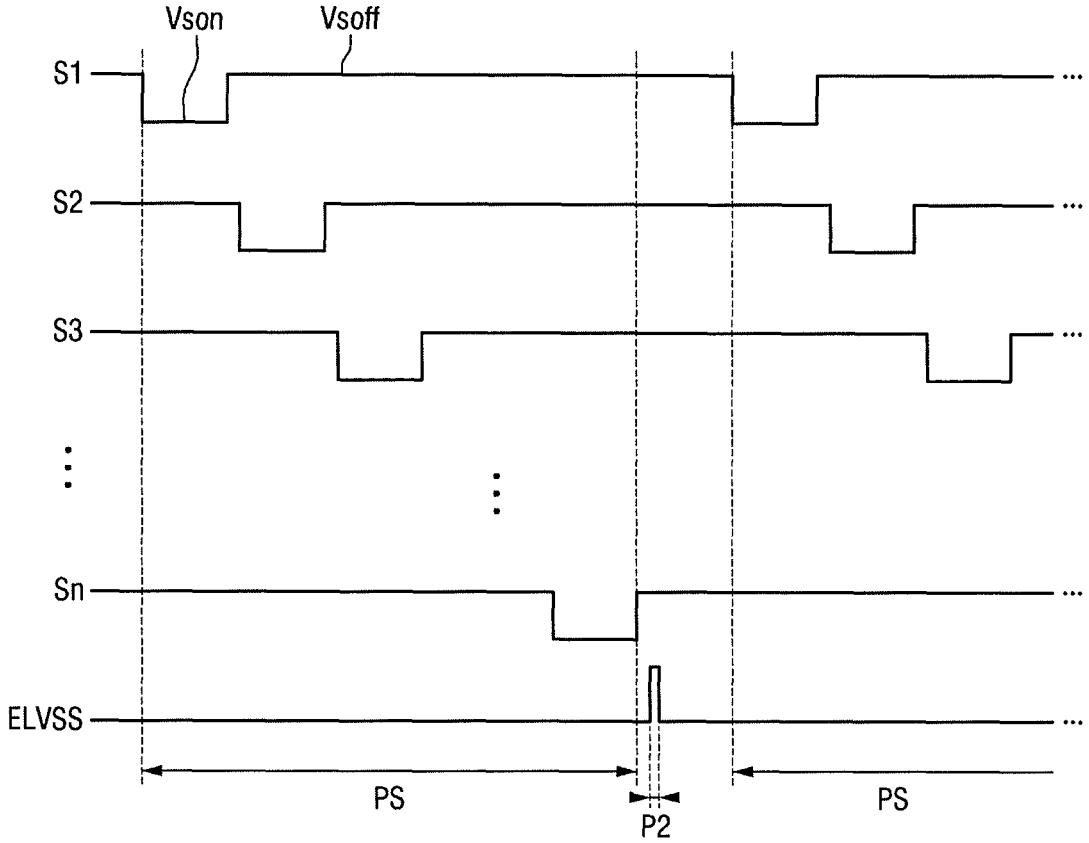
FIG. 5 is a waveform diagram illustrating waveforms of first to nth scan signals and a first power voltage according to an exemplary embodiment.

Hereinafter, a relationship between a change in the first power voltage ELVSS and the first to nth scan signals S1, S2, . . . , and Sn will be described with reference to FIG. 5. FIG. 5 is a waveform diagram illustrating waveforms of first to nth scan signals and a first power voltage according to an exemplary embodiment.

Referring to FIG. 5, the first to nth scan signals S1, S2, . . . , and Sn may sequentially have potentials of the scan-on voltage Vson and then have potentials of the scan-off voltage Vsoff. A period in which the scan-on voltage Vson is sequentially applied to the first scan signal Si to the nth scan signal Sn may be defined as a scan period PS. The scan period PS may mean a period ranging from a time in which the potential of the first scan signal S1 is changed from the scan-off voltage Vsoff to the scan-on voltage Vson to a time in which the potential of the nth scan signal Sn is changed from the scan-on voltage Vson to the scan-off voltage Vsoff. The second period P2 may be placed between two neighboring scan periods PS. If the second period P2 is placed between two neighboring scan periods PS, all of the first to nth scan signals S1, S2, . . . , and Sn have potentials of the scan-off voltage Vsoff in the second period P2. Thus, the threshold voltage compensation transistor T3 included in each of the pixels PX included in the organic light emitting display panel 10 is turned off, an increase in the first power voltage ELVSS does not affect the voltage charged in the capacitor C1 corresponding to voltages of the first to mth data signals D1, D2, . . . , and Dm in the second period P2, and deformation of an image may be prevented due to initialization of the anode voltage of the organic light emitting diode OLED.

Figure 6:
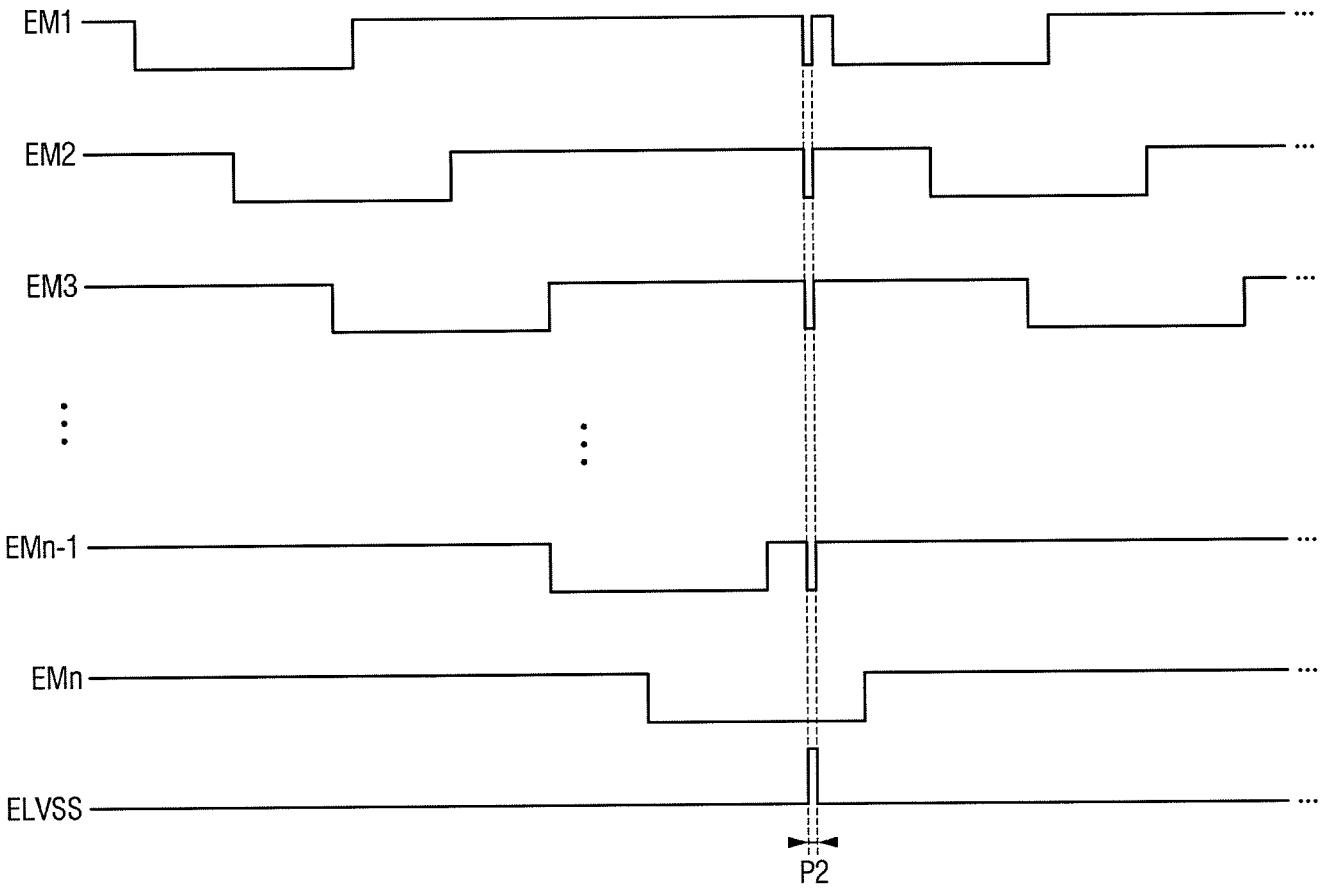
FIG. 6 is a waveform diagram illustrating waveforms of first to nth emission control signals and a first power voltage according to an exemplary embodiment.

Hereinafter, a relationship between a change in the first power voltage ELVSS and the first to nth emission control signals EM1, EM2, . . . , and EMn will be described with reference to FIG. 6, FIG. 6 is a waveform diagram illustrating waveforms of first to nth emission control signals and a first power voltage according to an exemplary embodiment.

Referring to FIG. 6, the first to nth emission control signals EM1, EM2, . . . , and EMn may sequentially have the emission-on voltage Veon and then have the emission-off voltage Veoff. However, in the second period P2, all of the first to nth emission control signals EM1, EM2, . . . , and EMn may have the emission-on voltage Veon. If all of the first to nth emission control signals EM1, EM2, . . . , and EMn have the emission-on voltage Veon, the first and second emission control transistors T4 and T5 of all of the pixels PX included in the organic light emitting display panel 10 are turned on, thereby connecting the source S of the driving transistor Td and the anode of the organic light emitting diode OLED and applying the second power voltage ELVDD to the source S of the driving transistor Td. If all of the first to nth emission control signals EM1, EM2, . . . , and EMn have the emission-on voltage Veon, the driving transistor Td of all of the pixels PX included in the organic light emitting display panel 10 and the organic light emitting diode OLED are connected in the same manner, thereby reducing the possibility of and/or preventing non-uniformity of an image due to initialization of the anode voltage of the organic light emitting diode OLED.

Figure 7:
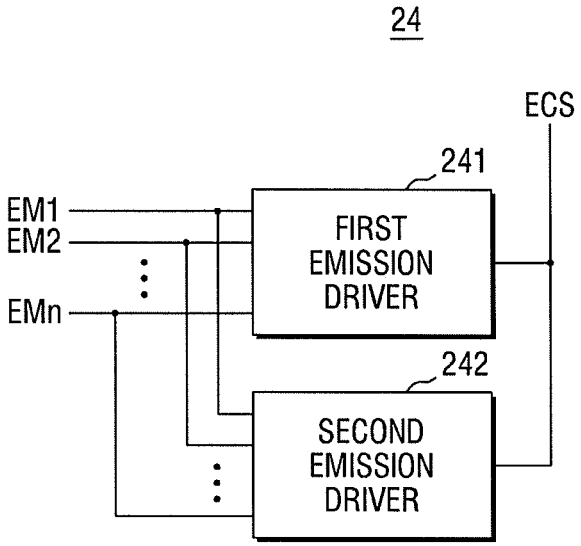
FIG. 7 is a block diagram of an emission driver according to an exemplary embodiment.

Hereinafter, an emission driver will be described in more detail with reference to FIG. 7. FIG. 7 is a block diagram of an emission driver according to an exemplary embodiment.

Referring to FIG. 7, the emission driver 24 may include a first emission driver 241 and a second emission driver 242.

The first emission driver 241 may generate and output the first to nth emission control signals EM1, EM2, . . . , and EMn such that the first to nth emission control signals EM1, EM2, . . . , and EMn sequentially have the emission-on voltage Veon and then have the emission-off voltage Veoff. If the second emission driver 242 is turned on, the first emission driver 241 may be turned off. A turned-on or turned-off state of the first emission driver 241 may be controlled by an emission driver control signal ECS. The first emission driver 241 may be turned on during a first period P 1.

The second emission driver 242 may generate and output the first to nth emission control signals EM1, EM2, . . . , and EMn such that the first to nth emission control signals EM1, EM2, . . . , and EMn simultaneously have the emission-on voltage Veon. If the first emission driver 241 is turned on, the second emission driver 242 may be turned off. A turned-on or turned-off state of the second emission driver 242 may be controlled by the emission driver control signal ECS. The second emission driver 242 may be turned on during a second period P2. During the second period P2, the second emission driver 242 may generate and output the first to nth emission control signals EM1, EM2, . . . , and EMn such that the first to nth emission control signals EM1, EM2, . . . , and EMn simultaneously have the emission-on voltage Veon.

Figure 8:
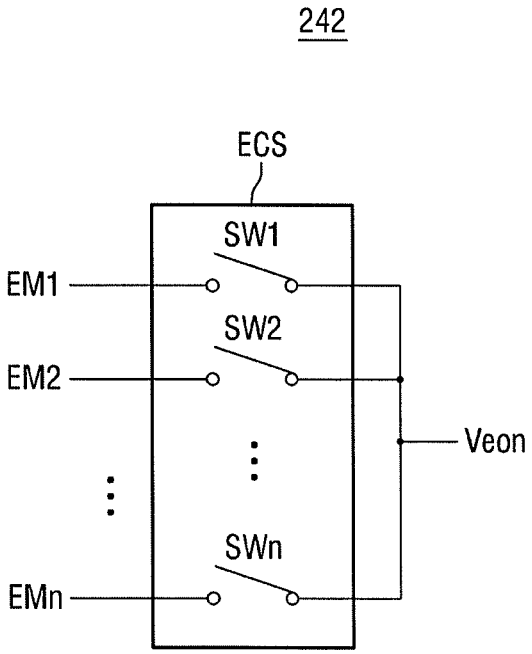
FIG. 8 is a block diagram of a second emission driver according to an exemplary embodiment.

Hereinafter, the second emission driver 242 will be described in more detail with reference to FIG. 8. FIG. 8 is a block diagram of a second emission driver according to an exemplary embodiment.

Referring to FIG. 8, the second emission driver 242 may include first to nth switches SW1, SW2, . . . , and SWn. Each of the first to nth switches SW1, SW2, . . . , and SWn may control each of the first to nth emission control signals EM1, EM2, . . . , and EMn to have the emission-on voltage Veon. The first to nth switches SW1, SW2, . . . , SWn may be simultaneously turned on or off. Turned-on or turned-off states of the first to nth switches SW1, SW2, . . . , and SWn may be controlled by the emission driver control signal ECS.

By way of summation and review, an organic light emitting display device may include an organic light emitting display panel and a driver. The organic light emitting display panel may include a plurality of scan lines, a plurality of data lines that cross the plurality of scan lines, and a plurality of pixels positioned at intersections of the plurality of scan lines and the plurality of data lines. Each of the plurality of pixels is a light emitting device and may include an organic light emitting diode therein.

The organic light emitting diode may be controlled by scan signals generated from the driver and transmitted to the plurality of scan lines and data signals generated from the driver and transmitted to the plurality of data lines. The organic light emitting diode may emit light with gray scales corresponding to the current flowing therein, and may include a thin film transistor to control the current flowing in the organic light emitting display panel using the data signals and the scan signals.

In a first frame of an image displayed on the organic light emitting display panel, a voltage applied to an anode of the organic light emitting diode remains even after a display period of the first frame, so that it may affect displaying of a second frame subsequent to the first frame. In particular, when a gray scale with which the image intends to be displayed is lower in the second frame than in the first frame, the voltage remaining in the anode of the organic light emitting diode may reduce a drop of the gray scale, thereby allowing the organic light emitting diode to emit light with a higher gray scale than a desired gray scale. Therefore, if the voltage remains in the anode of the organic light emitting diode, display quality of a black image may deteriorate.

In contrast, embodiments relate to an organic light emitting display device and a driving method of the same, which can improve display quality of a black image. Further, a pixel configuration can be simplified, thereby improving display quality of a black image. Embodiments also relate to an organic light emitting display device that can simplify a pixel configuration, thereby improving display quality of a black image.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device, comprising:

an organic light emitting display panel; and a driver to drive the organic light emitting display panel, wherein the driver is to apply a first power voltage and a second power voltage to the organic light emitting display panel, the first power voltage at a substantially constant voltage lower than the second power voltage during a first period which includes an emission period and at least one non-emission period, and the first power voltage being higher than the second power voltage during a second period, and wherein the second power voltage is to be substantially constant during the first and second periods, wherein the first period and the second period are alternately provided.

2. The organic light emitting display device of claim 1, wherein:

the organic light emitting display panel includes a plurality of pixels, each of the plurality of pixels including an organic light emitting diode and a driving transistor to control the current flowing in the organic light emitting diode, and the first power voltage is to be applied to a cathode of the organic light emitting diode, and the second power voltage is to be applied to a source of the driving transistor.

3. The organic light emitting display device of claim 2, wherein each of the plurality of pixels further includes:

a first emission control transistor that is connected to the source of the driving transistor and that controls whether the second power voltage is to be applied to the source of the driving transistor; and a second emission control transistor that is connected to a drain of the driving transistor and an anode of the organic light emitting diode.

4. The organic light emitting display device of claim 3, wherein:

the first emission control transistor and the second emission control transistor are to be controlled by an emission control signal, a potential of the emission control signal being one of an emission-on voltage and an emission-off voltage, and when the emission control signal has the potential of the emission-on voltage, the first emission control transistor and the second emission control transistor are to be turned on, and during the second period, the emission control signal is to have the potential of the emission-on voltage.

5. The organic light emitting display device of claim 4, wherein all emission signals are to be applied to the plurality of pixels have the potential of the emission-on voltage during the second period.

6. The organic light emitting display device of claim 4, wherein the driver includes an emission driver to generate the emission control signal.

7. The organic light emitting display device of claim 6, wherein the emission driver includes:

a first emission driver to sequentially apply the emission-on voltage of the emission control signal to the plurality of pixels, and a second emission signal generator to simultaneously apply the emission-on voltage of the emission control signal to the plurality of pixels.

8. The organic light emitting display device of claim 7, wherein the first emission driver is to be turned off and the second emission driver is to be turned on during the second period.

9. The organic light emitting display device of claim 3, wherein during the second period, the first emission control transistor is to be turned on to apply the second power voltage to the source of the driving transistor, and the second emission control transistor is to be turned on to connect the drain of the driving transistor to the anode of the organic light emitting diode.

10. The organic light emitting display device of claim 9, wherein during the second period, all of the first emission control transistors and the second emission control transistors included in the plurality of pixels are to be turned on.

11. The organic light emitting display device of claim 1, wherein:

the driver is to apply first to nth scan signals and first to mth data signals to the organic light emitting display panel, and potentials of the first to nth scan signals are scan-on voltages or scan-off voltages, the first to nth scan signals sequentially have potentials of the scan-on voltages during a scan period, and the second period is placed between two neighboring scan periods.

12. The organic light emitting display device of claim 1, wherein the first period excludes a scan period.

13. A driving method of an organic light emitting display device, the method comprising:

during a scan period, sequentially applying the first to nth scan signals to an organic light emitting display panel, each of the first to nth scan signals changing from a potential of a scan-on voltage to a scan-off voltage, and applying a first power voltage and a second power voltage to the organic light emitting display panel in an intervening period between two neighboring scan periods, the applying including changing the first power voltage from a higher potential than the second power voltage to a substantially constant voltage lower potential than the second power voltage during the intervening period, the intervening period including an emission period and at least one non-emission period, and during the scan period, the first power voltage has a lower potential than the second power voltage, and wherein the second power voltage is substantially constant during the neighboring scan periods and the intervening period, wherein the first period and the second period are alternately provided.

14. The driving method of claim 13, wherein the organic light emitting display panel includes a plurality of pixels, each of the plurality of pixels including an organic light emitting diode and a driving transistor controlling the current flowing in the organic light emitting diode, the first power voltage being applied to a cathode of the organic light emitting diode, and the second power voltage being applied to the source of the driving transistor.

15. A driving method of an organic light emitting display device, the method comprising:

sequentially changing potentials of first to nth emission signals applied to an organic light emitting display panel from emission-on voltages to emission-off voltages; and applying a first power voltage and a second power voltage supplied to the organic light emitting display panel between two neighboring scan periods, wherein:

while the first power voltage has a higher potential than the second power voltage, all of the first to nth emission signals have emission-on voltage potentials, and a length of a first period in which the first power voltage has the higher potential than the second power voltage is smaller than a second period in which the second power voltage has a higher potential than the first power voltage, wherein the second period includes an emission period and at least one non-emission period, the first power voltage at a substantially constant voltage lower than the second power voltage during the second period and the second power voltage having a substantially constant value during the first and second periods, wherein the first period and the second period are alternately provided.

16. The driving method of claim 15, wherein the organic light emitting display panel includes a plurality of pixels, and each of the plurality of pixels receives one of the first to nth emission signals and light is emitted when one of the first to nth emission signals has the emission-on voltage.

17. The driving method of claim 15, further comprising:

activating a first emission driver and a second emission driver at different times, the first emission driver sequentially changing the first to nth emission signals from the emission-on voltages to the emission-off voltages, and the second emission driver generating the first to nth emission signals to simultaneously have emission-on voltages.

18. The driving method of claim 17, wherein, when the first emission driver is turned on, the second emission driver is turned off, and when the second emission driver is turned on, the first emission driver is turned off.

19. The driving method of claim 18, wherein, while the first power voltage has the higher potential than the second power voltage, the second emission driver is turned on.

20. The driving method of claim 18, wherein, while the second power voltage has the higher potential than the first power voltage, the first emission driver is turned on.

* * * * *